US008051570B1

(12) United States Patent
Brown

(10) Patent No.: US 8,051,570 B1
(45) Date of Patent: Nov. 8, 2011

(54) MULTI-USE KITCHEN UTILITY KNIFE

(76) Inventor: Amanda Brown, Bethlehem, PA (US)

( * ) Notice: Subject to any disclaimer, the term of this patent is extended or adjusted under 35 U.S.C. 154(b) by 262 days.

(21) Appl. No.: 12/469,001

(22) Filed: May 20, 2009

(51) Int. Cl.
*B65B 3/08* (2006.01)
*A47J 43/26* (2006.01)

(52) U.S. Cl. ..... 30/123.3; 30/125; 222/192; 401/266

(58) Field of Classification Search ..... 30/41, 123.3, 30/125, 141, 295, 298.4; 222/192; 401/266
See application file for complete search history.

(56) References Cited

U.S. PATENT DOCUMENTS 1,836,800 A * 12/1931 Hope ..... 30/41
2,450,860 A 10/1948 Proffit
2,789,349 A * 4/1957 Lee ..... 30/298.4
3,090,071 A 5/1963 Le Brooy
3,154,418 A 10/1964 Lovell et al.
3,248,754 A 5/1966 De Mario
3,536,411 A * 10/1970 Eisert ..... 401/176
D246,563 S 12/1977 Hube
5,288,274 A * 2/1994 Bell et al. ..... 472/52
D346,040 S 4/1994 Andregg
5,890,630 A * 4/1999 Lobdell ..... 222/192
5,894,959 A 4/1999 Sigurtidason
5,908,257 A * 6/1999 Martin ..... 401/271
6,039,483 A * 3/2000 Szekely ..... 401/50
6,224,574 B1 * 5/2001 Al-Labban ..... 604/187
6,932,530 B1 * 8/2005 Bissel ..... 401/11
7,127,817 B2 * 10/2006 Orloff et al. ..... 30/41
7,325,994 B2 2/2008 Liberatore

* cited by examiner

*Primary Examiner* — Hwei C Payer

(57) ABSTRACT

The multi-use kitchen utility knife includes a handle containing a compartment for storage of a material that is distributed onto a side opposite of the knife blade. The contents of the compartment being advanced via a threaded advance knob that can be removed to provide access to the compartment for refilling or cleaning.

7 Claims, 4 Drawing Sheets

MULTI-USE KITCHEN UTILITY KNIFE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of kitchen gadgetry, more specifically, a utility knife that doubles as a condiment dispenser.

B. Discussion of the Prior Art

As a preliminary note, it should be stated that there is an ample amount of prior art that deals with kitchen knives. As will be discussed immediately below, no prior art discloses a kitchen knife that can both cut and dispense a condiment from a compartment integrated in the base of the knife.

The Sigurlidason Patent (U.S. Pat. No. 5,894,959) discloses a viscous substance, dispensing knife. However, the reservoir relies upon an air pump to dispense the liquid as opposed to a threaded advance knob that pushes the contents of the reservoir down the length of the handle. Also, the dispensing outlets are located on a side of the blade as opposed to along a top edge of the blade, which provides an improvement upon the existing art in that the surface of the blade can remain free of the contents of the compartment.

The Lovell Patent (U.S. Pat. No. 3,154,418) discloses a packaging and stirring implement for making beverages. However, the implement is not directed to a knife with a compartment for storing and distributing a condiment.

The De Mario Patent (U.S. Pat. No. 3,248,754) discloses a putty knife having means associated therewith for delivering putty or a similar material to the end of the blade for application at a desired point. However, the putty bag is situated between two blades as opposed to a compartment inside of the handle that stores the material to be distributed.

The Liberatore Patent (U.S. Pat. No. 7,325,994) discloses an apparatus for use with a hand manipulable flowable material, the combination comprising a dispensing nozzle associated with the dispenser to dispense material, and a spreader surface associated with the nozzle. However, the apparatus does not involve a knife having a compartment located within a handle and of which is dispensed along a side opposite a knife edge wherein the contents of said compartment are advanced via a threaded advance knob that doubles as a refilling port.

The Proffit Patent (U.S. Pat. No. 2,450,860) discloses an article dispersing lead trowel. However, the trowel does not have a threaded advance knob that rotates to push the material along the length of a compartment located within the handle, and if which is dispensed on an edge opposite a knife blade.

The Hube Patent (U.S. Pat. No. Des. 246,563) illustrates an ornamental design for a knife that does not depict a compartment or threaded advance knob in fluid connection with said compartment.

While the above-described devices fulfill their respective and particular objects and requirements, they do not describe a kitchen utility knife that has a compartment located within the handle and wherein the contents of said compartment are advanced via a threaded advance knob that doubles as a refilling port, and wherein said contents of said compartment are distributed along an edge opposite the knife blade. In this regard, the improved kitchen utility knife from the conventional concepts and designs of the prior art.

SUMMARY OF THE INVENTION

The multi-use kitchen utility knife includes a handle containing a compartment for storage of a material that is distributed onto a side opposite of the knife blade. The contents of the compartment being advanced via a threaded advance knob that can be removed to provide access to the compartment for refilling or cleaning.

An object of the invention is to provide a knife with a refillable reservoir that is located within the handle of which the contents are moved via a threaded advance knob located along an end of the handle and wherein the contents are distributed along an edge opposite the knife blade.

A further object of the invention is to provide a kitchen utility knife that has a compartment that can be cleaned and refilled via removal of the threaded advance knob.

These together with additional objects, features and advantages of the kitchen utility knife will be readily apparent to those of ordinary skill in the art upon reading the following detailed description of presently preferred, but nonetheless illustrative, embodiments of the kitchen utility knife when taken in conjunction with the accompanying drawings.

In this respect, before explaining the current embodiments of the kitchen utility knife in detail, it is to be understood that the kitchen utility knife is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the kitchen utility knife.

It is therefore important that the claims be regarded as including such equivalent construction insofar as they do not depart from the spirit and scope of the kitchen utility knife. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
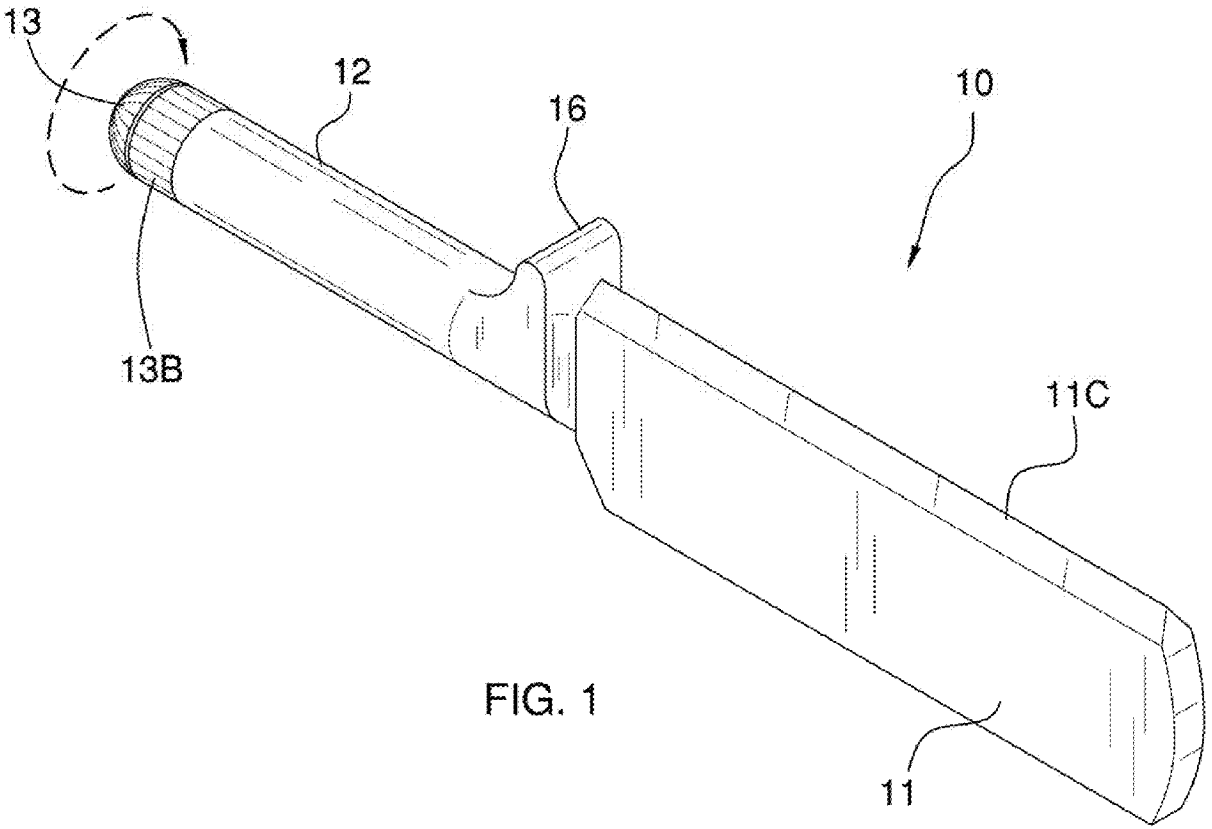
FIG. 1 illustrates an isometric view of the kitchen utility knife with an arrow indicating rotational movement of the threaded advance knob.
Figure 2:
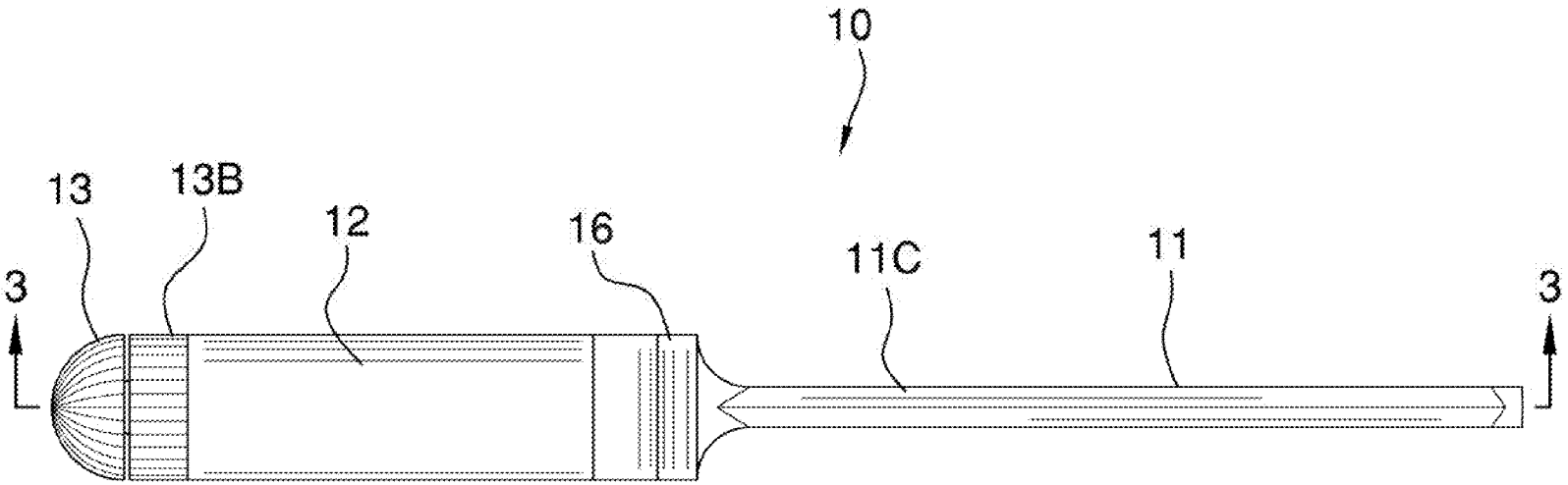
FIG. 2 illustrates a bottom view of the kitchen utility knife and the blade's edge.
Figure 3:
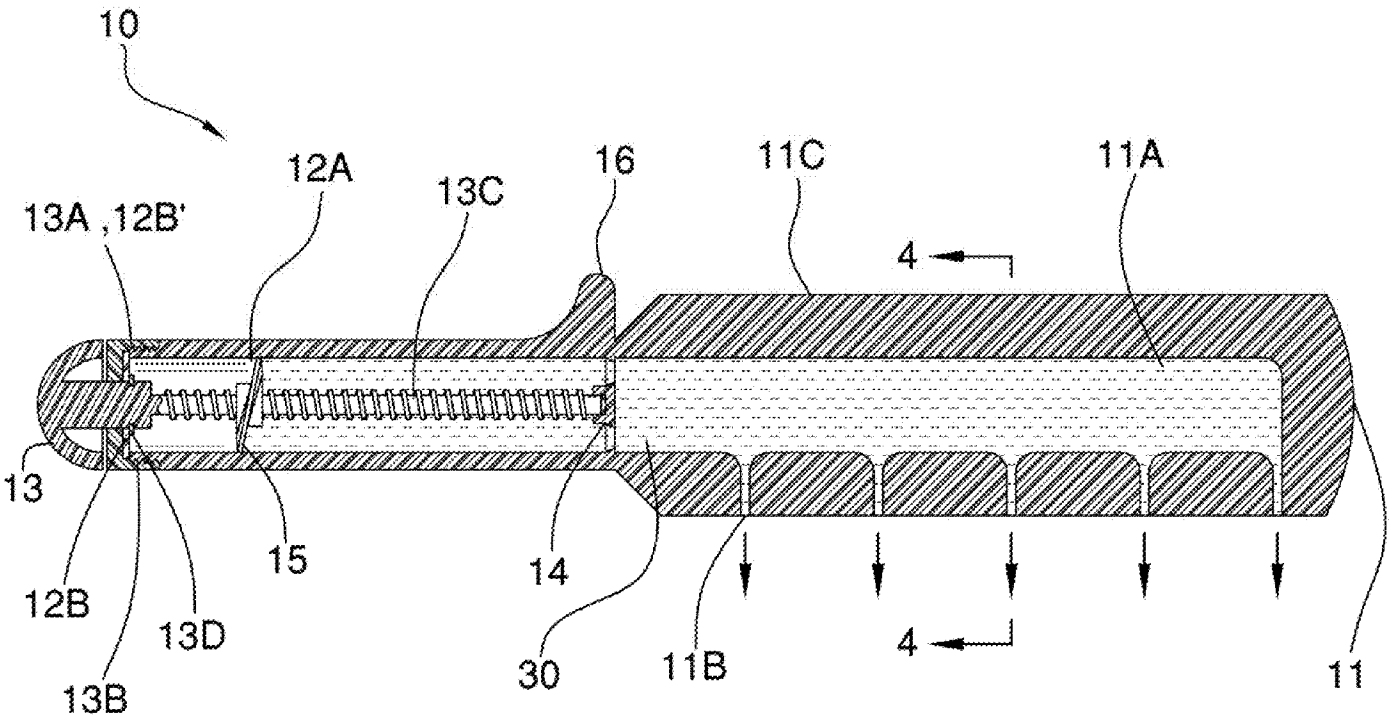
FIG. 3 illustrates a cross-sectional view of the kitchen utility knife along line 3-3 in FIG. 2 with arrows indicating movement of material through the compartment and out the plurality of dispensing ports.
Figure 4:
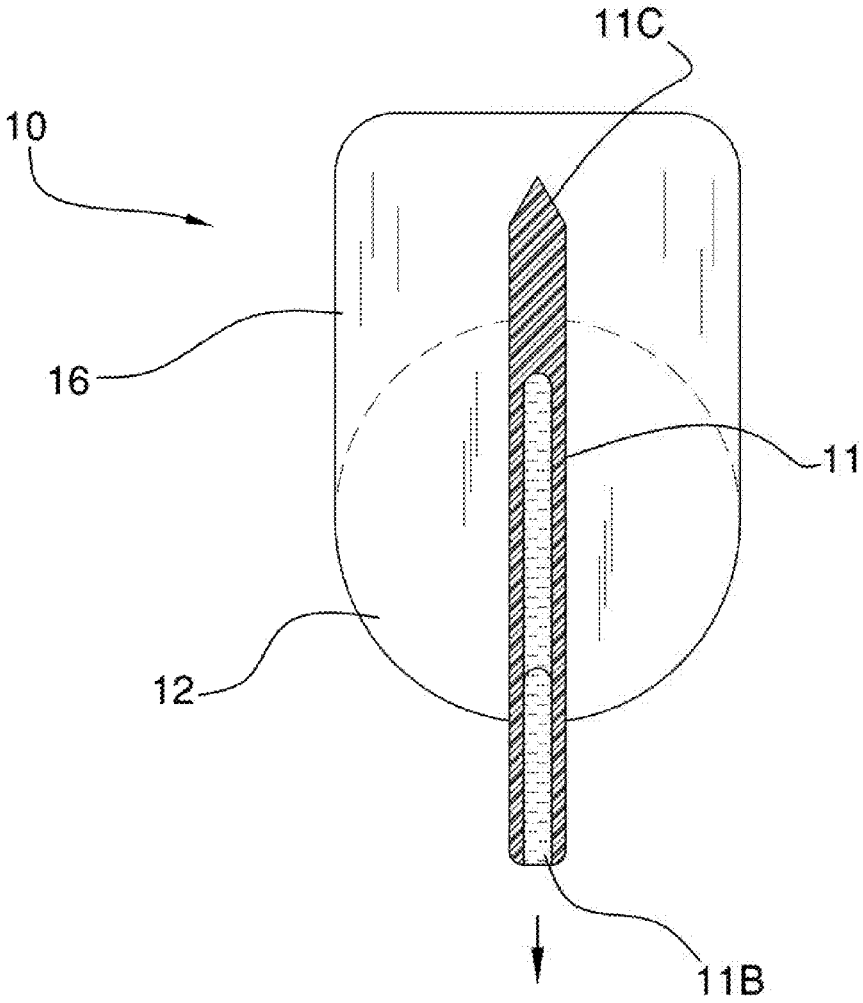
FIG. 4 illustrates a cross-sectional view of the kitchen utility knife along line 4-4 in FIG. 2 detailing movement of material out the dispensing ports.

Detailed reference will now be made to the preferred embodiment of the invention, examples of which are illustrated in FIGS. 1-4. A kitchen utility knife 10 (hereinafter invention) includes a knife blade 11 and a handle 12.

Located within the handle 12 is a compartment 12A. The compartment 12A of the handle 12 is in fluid connection with a dispersing duct 11A located within the knife blade 11. The dispersing duct 11A extends to a plurality of dispensing ports 11B.

The dispersing ports 11B are located opposite a knife-edge 11C. The location of the dispersing ports 11B with respect to the knife-edge 11C shall be opposing and is an important feature of the invention 10 in that the dispersion of a material 30 out of the dispersing ports 11B shall keep said material 30 away from the knife-edge 11C in order to enable a clean knife-edge 11C for other uses. The surface of the knife blade 11 adjacent the dispersing ports 11B is best suited for spreading said material 30.

The compartment 12A is accessible from an opening 12B located at a base end of the handle 12. The opening 12B enables the compartment 12A to be refilled with the material 30 or cleaned. The exterior surface around the opening 12B is adorned with external threading 12B'.

A rotating member 13B attaches to the opening 12B via internal threading 13A that corresponds with the external threading 12B' of the opening 12B. A threaded advance knob 13 is secured to the rotating member 13B for rotating a rod 13A. The rod 13C runs the length of the compartment 12A and engages an alignment guide 14. A pusher plate 15 traverses back and forth along the length of the rod 13C via rotation of said rod 13C via the rotation of the threaded advance knob 13.

As the pusher plate 15 moves away from the opening 12B, material 30 is pushed out of the compartment 12A, into the dispersing duct 11A, and out of the dispersing ports 11B. The pusher plate 15, as depicted, has a curved surface. However, it shall be noted that the pusher plate 15 may resemble a flat circle.

It shall be further noted that the shape of the pusher plate 15 shall conform to the cross-sectional shape of the compartment 12A in order to ensure movement of all material 30. It shall be further noted that the shape of the compartment 12A, handle 12, and for that matter the pusher plate 15 shall comprise different geometries, and are hereby rendered obvious.

The threaded advance knob 13, the rotating member 13B, the rod 13C, and the pusher plate 15 are removed from the handle 12 and compartment 12A via unscrewing of the threaded advance knob 13 from the opening 12B.

The threaded advance knob 13 and the rod 13C are secured to one another via a fastening means comprising an adhesive, welding, riveting, nailing, screwing, or molding the two parts together. The threaded advance knob 13 is secured about the rotating member 13B via a retaining ring 13D, see FIG. 3.

A finger guard 16 is located on the handle 12 and prevents fingers from sliding underneath the knife-edge 11C when in use.

The knife blade 11, the handle 12, the threaded advance knob 13, the rotating member 13B, the rod 13C, the retaining ring 13D, the alignment guide 14, the pusher plate 15, and the finger guard 16 are made of a material comprising a plastic, metal, or wood.

The material 30 shall be of sufficient viscosity to permit movement about the compartment 12A, dispersing duct 11A, and out the dispersing ports 11B. It is envisioned that the material 30 suitable for use with the invention 10 shall comprise spreadable foods like peanut butter, jelly, butter, ketchup, mustard, barbeque sauce, or other sauces of similar consistencies.

With respect to the above description, it is to be realized that the optimum dimensional relationship for the various components of the invention 10 to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A kitchen utility knife comprising:

a knife blade and handle combination wherein a compartment located within the handle can be filled with a viscous substance that can be passed from said compartment into a dispensing duct located within said knife blade and exit through at least one dispensing port located on an edge opposite a knife edge of the knife blade, and wherein movement of said material is accomplished via rotational movement of a threaded advance knob located at a base end of the handle, which in turn traverses a pusher plate back and forth within said compartment;

wherein the threaded advance knob screws onto an opening located the base end of the handle;

wherein a rod extends from the threaded advance knob and along the length of the compartment and interacts with an alignment guide and of which said rod has threading that corresponds to the pusher plate;

wherein a retaining ring secures a rotating member to the threaded advance knob such that the rotating member screws onto the opening at the base end of the handle, and enables the threaded advance knob and the rod to rotate thereabout, and thus progress the pusher plate backwards or forwards within the compartment;

wherein the cross-sectional shape of the pusher plate conforms to the cross-sectional shape of the compartment.

2. The knife as described in claim 1 wherein the handle has a finger guard to prevent a finger or fingers from sliding pass the handle and under the knife edge when in use.

3. The knife as described in claim 1 wherein the handle and the knife blade are made of a material comprising a wood, metal, or plastic.

4. A kitchen utility knife comprising:

a knife blade and handle combination wherein a compartment located within the handle can be filled with a viscous substance that can be passed from said compartment into a dispensing duct located within said knife blade and exit through at least one dispensing port located on an edge opposite a knife edge of the knife blade, and wherein movement of said material is accomplished via rotational movement of a threaded advance knob located at a base end of the handle, which in turn traverses a pusher plate back and forth within said compartment;

wherein the threaded advance knob screws onto an opening located at the base end of the handle;

wherein a rod extends from the threaded advance knob and along the length of the compartment and interacts with an alignment guide and of which said rod has threading that corresponds to the pusher plate;

wherein a retaining ring secures a rotating member to the threaded advance knob such that the rotating member screws onto the opening at the base end of the handle, and enables the threaded advance knob and the rod to rotate thereabout, and thus progress the pusher plate backwards or forwards within the compartment.

5. The knife as described in claim 4 wherein the cross-sectional shape of the pusher plate conforms to the cross-sectional shape of the compartment.

6. The knife as described in claim 4 wherein the handle has a finger guard to prevent a finger or fingers from sliding pass the handle and under the knife edge when in use.

7. The knife as described in claim 4 wherein the handle and the knife blade are made of a material comprising a wood, metal, or plastic.

* * * * *